US011408561B2

(12) United States Patent
Fournel et al.

(10) Patent No.: US 11,408,561 B2
(45) Date of Patent: Aug. 9, 2022

(54) CONTAINER FOR STORING AND TRANSPORTING LIQUEFIED GAS

(71) Applicant: L'Air Liquide, Société Anonyme pour l'Etude et l'Exploitation des Procédés Georges Claude, Paris (FR)

(72) Inventors: Jean-Luc Fournel, Sassenage (FR); Romain Bois, L'Albenc (FR); Marine Garcia, St. Egreve (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 142 days.

(21) Appl. No.: 16/979,073

(22) PCT Filed: Feb. 27, 2019

(86) PCT No.: PCT/FR2019/050449
§ 371 (c)(1),
(2) Date: Sep. 8, 2020

(87) PCT Pub. No.: WO2019/170981
PCT Pub. Date: Sep. 12, 2019

(65) Prior Publication Data

US 2021/0164614 A1 Jun. 3, 2021

(30) Foreign Application Priority Data

Mar. 8, 2018 (FR) ..... 1852005

(51) Int. Cl.
*F17C 1/12* (2006.01)
*F17C 1/00* (2006.01)
(Continued)

(52) U.S. Cl.
CPC ..... *F17C 1/00* (2013.01); *F17C 1/12* (2013.01); *F17C 13/001* (2013.01); *F17C 13/08* (2013.01);
(Continued)

(58) Field of Classification Search
CPC ..... F17C 1/12; F17C 13/001; F17C 13/08; F17C 2201/035; F17C 2203/0387;
(Continued)

(56) References Cited

U.S. PATENT DOCUMENTS 2,229,080 A 1/1941 Zenner et al.
2,467,428 A 4/1949 Hansen et al.
(Continued)

FOREIGN PATENT DOCUMENTS

DE 10 2008 054 090 12/1958
DE 10 2014 206 370 10/2015
WO WO 2017 190846 11/2017

OTHER PUBLICATIONS

International Search Report and Written Opinion for corresponding PCT/FR2019/050449, dated May 10, 2019.

*Primary Examiner* — Stephen J Castellano
(74) *Attorney, Agent, or Firm* — Elwood L. Haynes

(57) ABSTRACT

A container for storing and transporting liquefied gas, having a first, internal reservoir that extends in a longitudinal direction (A) and is configured to store the liquefied gas, a second, external reservoir that is disposed around the first reservoir with a vacuum insulated space between the first and the second reservoir, a third, annular reservoir that is disposed around the first reservoir, between the first and the second reservoir, the third reservoir extending around at least a part of the first reservoir and containing a liquefied gas in order to form a heat shield for thermally insulating the
(Continued)

first reservoir, and a device for holding the first and third reservoirs in the second reservoir.

17 Claims, 4 Drawing Sheets

(51) Int. Cl.
*F17C 13/00* (2006.01)
*F17C 13/08* (2006.01)

(52) U.S. Cl.
CPC ..... *F17C 2201/0109* (2013.01); *F17C 2201/035* (2013.01); *F17C 2201/052* (2013.01); *F17C 2203/015* (2013.01); *F17C 2203/018* (2013.01); *F17C 2203/0366* (2013.01); *F17C 2203/0387* (2013.01); *F17C 2203/0391* (2013.01); *F17C 2203/0631* (2013.01); *F17C 2203/0643* (2013.01); *F17C 2205/0149* (2013.01); *F17C 2205/0192* (2013.01); *F17C 2221/017* (2013.01); *F17C 2223/0161* (2013.01)

(58) Field of Classification Search
CPC ..... F17C 2203/0391; F17C 2203/0631; F17C 2205/0192; F17C 2205/0149; F17C 2203/0316
See application file for complete search history.

(56) References Cited

U.S. PATENT DOCUMENTS

| | | | | |
|---|---|---|---|---|
| 2,587,204 | A | 2/1952 | Patch, Jr. et al. | |
| 2,863,297 | A | 12/1958 | Johnston | |
| 3,129,836 | A * | 4/1964 | Frevel | B01J 19/0053 206/521 |
| 5,005,362 | A | 4/1991 | Weltmer, Jr. et al. | |
| 2019/0145580 | A1 | 5/2019 | Posselt et al. | |

* cited by examiner

CONTAINER FOR STORING AND TRANSPORTING LIQUEFIED GAS

CROSS REFERENCE TO RELATED APPLICATIONS

This application is a 371 of International Application No. PCT/FR2019050449, filed Feb. 27, 2019, which claims priority to French Patent Application No. 1852005, filed Mar. 8, 2018, the entire contents of which are incorporated herein by reference.

BACKGROUND

The invention relates to a container for storing and transporting liquefied gas.

The invention relates more particularly to a container for storing and transporting liquefied gas, in particular cryogenic fluid such as helium, comprising a first, internal reservoir that extends in a longitudinal direction and is intended to store the liquefied gas, a second, external reservoir that is disposed around the first reservoir with a vacuum insulated space between the first and the second reservoir, the container comprising a third, annular reservoir that is disposed around the first reservoir, between the first and the second reservoir, the third, annular reservoir extending around at least a part of the first reservoir and containing a liquefied gas in order to form a heat shield for thermally insulating the first reservoir, the container comprising a device for holding the first and third reservoirs in the second reservoir, the holding system being configured to allow limited travel of the first and third reservoirs in the second reservoir in particular in the longitudinal direction when they undergo dimensional variations caused by temperature variations, the holding system comprising a set of tie rods.

The transport of liquefied gas, in particular helium, generally uses vacuum insulated containers or "iso containers".

Specifically, it is only possible to transport liquid helium over long distances if the thermal performance levels of the cryogenic storage are excellent. The ingress of heat into a cryogenic container having a capacity of 41 000 l should be around 4.5 W for example.

Radiation represents the most significant contribution of heat ingress. In order to achieve these performance levels, it is necessary to protect the liquid helium reservoir from radiation by an active heat shield (aluminum or copper for example) cooled for example by liquid nitrogen. Cf. for example U.S. Pat. No. 5,005,362.

The flux of the radiation slowly vaporizes the nitrogen. The enthalpy of vaporization keeps the temperature of the shield at around −196° C. The nitrogen thus vaporized is evacuated to the atmosphere through a pipe in order to keep the nitrogen guard at low pressure, typically 0.5 bar. The liquid nitrogen is thus "consumed" during transport. The nitrogen reservoir is dimensioned in terms of the consumption per unit time and the maximum transport duration.

The autonomy of the container is dependent on this nitrogen reserve. Increasing this nitrogen reserve increases the autonomy (the duration for which insulation is guaranteed) but reduces the amount of available space for the interior reservoir storing the helium. For a transport duration of 45 days, the nitrogen reservoir is typically 1200 liters. In order to achieve a transport duration of 75 days, the nitrogen capacity has to be more than 3000 liters.

Moreover, the structural arrangement of these elements (including the pipe) in the external casing has to be able to withstand forces during transport or relative dimensional variations between the outer casing and the internal storage reservoirs (cold state filled with cryogenic fluid or warm state at ambient temperature).

The document U.S. Pat. No. 2,863,297 describes a reservoir comprising a fluid reserve interposed between the outer and inner walls.

However, this solution is inappropriate for addressing all or some of the above constraints.

SUMMARY

An aim of the present invention is to remedy all or some of the drawbacks of the prior art that are set out above.

To this end, the container according to the invention, which otherwise conforms with the generic definition thereof given in the above preamble, is essentially characterized in that at least some of the tie rods have a first end connected in an articulated manner to the second reservoir and a second end connected rigidly to the first reservoir or to the third reservoir or to a structural component rigidly connected to said first or third reservoir, said articulated tie rods being movable between two given angular positions that respectively define two distinct positions of the second end of the tie rods and correspond respectively to the extremes of the dimensional variations of the first and third reservoirs with respect to the second reservoir.

Furthermore, embodiments of the invention may have one or more of the following features:

- the container comprises a first set of tie rods having a first end connected to the second reservoir and a second end connected rigidly to the first reservoir, the first set of tie rods comprising a plurality of tie rods, in particular four tie rods, the first end of which is situated at a first longitudinal end of the second reservoir, the second end of the tie rods being connected to a first longitudinal end of the first reservoir,
- the first set of tie rods comprises two upper tie rods that have their first end connected to the upper part of the second reservoir and their second end connected to the lower part of the first reservoir, and two lower tie rods that have their first end connected to the lower part of the second reservoir and their second end connected to the upper part of the first reservoir,
- the container comprises a second set of tie rods having a first end connected to the second reservoir and a second end connected rigidly to the first reservoir, the second set of tie rods comprising a plurality of tie rods, in particular four tie rods, the first end of which is situated at a second longitudinal end of the second reservoir, the second end of the tie rods being connected to the second longitudinal end of the first reservoir,
- the second set of tie rods comprises two upper tie rods, the first ends of which are connected to the upper part of the second reservoir and the second ends of which are connected to the lower part of the first reservoir, and two lower tie rods that have their first ends connected to the lower part of the second reservoir and their second ends connected to the upper part of the first reservoir,
- in a plane perpendicular to the longitudinal direction, the upper tie rods intersect at an angle of between 70 and 130 degrees and preferably between 90 and 120 degrees, and in that the lower tie rods intersect at an angle of between 70 and 130 degrees and preferably between 90 and 120 degrees,
- in a plane parallel to the longitudinal direction, the upper tie rods intersect with the lower tie rods, the second reservoir has a cylindrical overall shape extending in the longitudinal direction with a given radius, the tie rods of the first set of tie rods and of the second set of tie rods, respectively, have a length of between 80 and 150% and preferably between 90 and 120% of the length of said radius, the container comprises a third set of tie rods, in particular four tie rods, that have a first end connected to the second reservoir and a second end connected to the fourth reservoir or to a support rigidly connected to the latter, the first end of the tie rods of the third set being situated at the first longitudinal end of the second reservoir, the second end of said tie rods being situated at the first longitudinal end of the container, the third set of tie rods comprises two upper tie rods, the first end of which is situated in the upper part of the second reservoir and the second end of which is situated in the upper part of the first reservoir, and two lower tie rods, the first end of which is connected to the lower part of the second reservoir and the second end of which is situated in the lower part of the first reservoir, the container comprises a fourth set of tie rods, in particular four tie rods, that have a first end connected to the second reservoir and a second end connected to the third reservoir or to a support rigidly connected to the latter, the first end of the tie rods of the third set being situated at the second longitudinal end of the second reservoir, the second end of said tie rods being situated at the second longitudinal end of the container, in a plane perpendicular to the longitudinal direction, the two upper tie rods are oriented relative to one another at an angle of between 60 and 110 degrees and preferably between 70 and 90 degrees, and the two lower tie rods are oriented relative to one another at an angle of between 60 and 110 degrees and preferably between 70 and 90 degrees, the tie rods of the third set of tie rods, and of the fourth set of tie rods, respectively, have a length of between 30 and 80% and preferably between 40 and 60% of the length of the radius of the section of the second reservoir, the articulated tie rods are configured to pivot about their end connected to the second reservoir through an angle of between 10 and 20 degrees, corresponding to travel of their second end in the longitudinal direction of between 1 and 50 mm, in particular between 30 and 40 mm, the container has a fixed and rigid link between, for the one part, a longitudinal end of the second reservoir and, for the other part, the adjacent longitudinal end of the first reservoir and one end of the third reservoir or of a support element secured to the latter, meaning that the fixed and rigid link prevents at least the longitudinal movement of one longitudinal end of the first and of the third reservoir with respect to the second reservoir, while allowing longitudinal travel of the opposite end of the first and third reservoir with respect to the second reservoir, the fixed and rigid link comprises walls that extend back and forth in the longitudinal direction so as to create an insulating thermal path between the second reservoir, for the one part, and the first and third reservoirs, for the other part, at least some of the ends of the tie rods connected to the lower part of the second reservoir are mounted on an elastic support that allows and a dampening a limited vertical travel with respect to the second reservoir, the container comprises one or more shielding walls that are thermally connected to the third reservoir and are disposed at the ends of the reservoir between the first and the second reservoir, the shielding walls form covers at each longitudinal end of the third reservoir so as to enclose the first reservoir in a shield formed by the third reservoir and the shielding walls, at least one of the tie rods passes through the shielding wall(s) via orifices, the third reservoir is delimited by two concentric cylindrical walls that are spaced apart by spacers and closed at the two longitudinal ends, the spacers have walls that extend in the longitudinal direction, the two concentric cylindrical walls and the spacers (16) are produced by extrusion.

The invention may also relate to any alternative device or process comprising any combination of the features above or below within the scope of the claims.

BRIEF DESCRIPTION OF THE DRAWINGS

For a further understanding of the nature and objects for the present invention, reference should be made to the following detailed description, taken in conjunction with the accompanying drawings, in which like elements are given the same or analogous reference numbers and wherein.

DETAILED DESCRIPTION OF PREFERRED EMBODIMENTS

Figure 1:
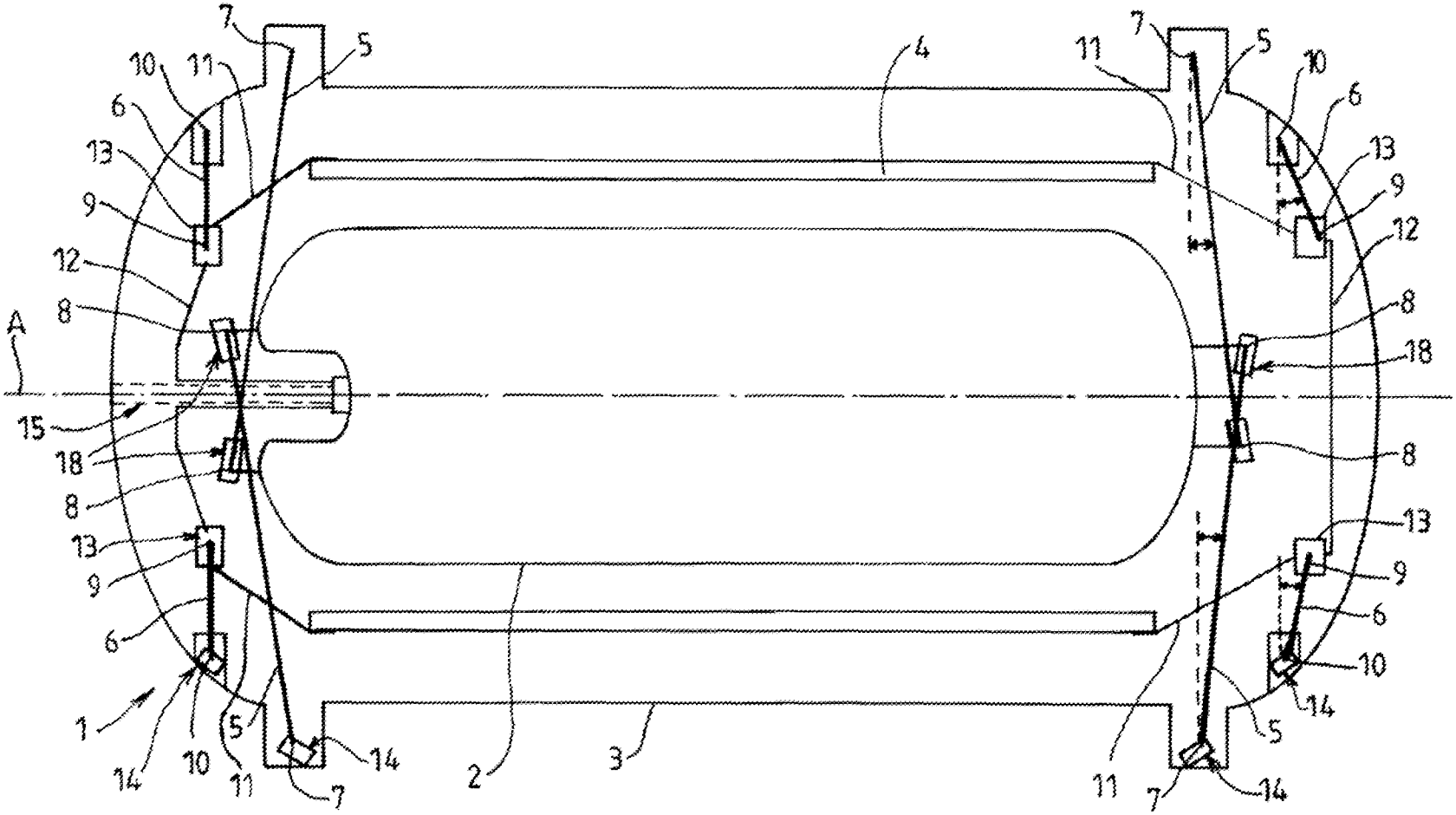
FIG. 1 shows a schematic and partial view in longitudinal section illustrating an example of the structure of a container according to the invention.

The container 1 for storing and transporting liquefied gas, in particular cryogenic fluid such as helium, illustrated in the figures preferably has a cylindrical overall shape that extends in a longitudinal direction A, which is horizontal in the use position.

This container 1 comprises a first, internal reservoir 2, preferably with a cylindrical overall shape, which extends in the longitudinal direction A.

This first reservoir 2, or internal reservoir, is intended to store the liquefied gas (helium or other cryogenic gas/liquid mixture).

The walls of the first reservoir 2 are made for example of a metallic material, for example an austenitic stainless steel or any other appropriate material.

The container 1 comprises a second reservoir 3, or "external" casing, disposed around the first reservoir 1 with a vacuum insulated space between the first 2 and the second 3 reservoir (and one or more layers of insulating material).

The second reservoir 3 has for example a cylindrical overall shape and may be concentric about the first reservoir 1.

The walls of the second reservoir 3 are made for example of a metallic material, for example a steel or austenitic stainless steel or any other appropriate material.

The container 1 comprises a third reservoir 4 disposed around the first reservoir 2, between the first 2 and the second 3 reservoir.

The third reservoir 4 (which is for example annular in section perpendicular to the longitudinal direction A) extends around at least a part of the first reservoir 2 in the longitudinal direction A. Preferably, this third reservoir 4 has a cylindrical shape and can be disposed concentrically around the first reservoir 2. This third reservoir 4, or intermediate reservoir, is intended to contain a liquefied gas, for example nitrogen, in order to form a heat shield ensuring thermal insulation of the first reservoir 2.

For example, the third reservoir 4 may comprise or be made up of two cylindrical shells that are concentrically spaced apart (different diameters) and are connected and closed at their ends by bulkheads. These two cylindrical walls thus form an annular volume having the dual function of storing the liquid nitrogen and of acting as a heat shield for the first reservoir 2.

For a small annular height, for example 40 mm, the volume thus created can be 3100 liters for a 40 foot (approximately 12 meter) ISO container.

Preferably, the container 1 also comprises one or more shielding walls 11, 12 that are thermally connected to the third reservoir 4 and are disposed at the ends of the reservoir between the first 2 and the second 3 reservoir.

These walls 11, 12 (aluminum or copper plates for example) form covers at the ends or bottoms of the container to close the shield around the first reservoir 2. These plates are "thermalized" (that is to say cooled) by the third reservoir 4.

The container 1 comprises a device for holding the first 2 and third 4 reservoirs in the second reservoir 3.

The holding system supports/suspends the 2 and third 4 reservoirs in the second reservoir 3.

This holding system is configured to allow limited travel of the first 2 and third 4 reservoirs in the second reservoir 3, in particular in the longitudinal direction A, when they undergo dimensional variations (expansions/contractions in hot or cold states).

As can be seen in the figures, the holding system comprises a set of tie rods 5, 6, at least some of which have a first end 7 connected in an articulated manner to the second reservoir 3 and a second end 8, 9 connected rigidly to the first reservoir 2 or to the third reservoir 4 (or to a structural component rigidly linked to said first 2 or third 4 reservoir).

As schematically depicted in FIG. 1, the articulated tie rods 5, 6 are movable between two given angular positions that respectively define two distinct positions of the second end 8, 9 of the tie rods. These two positions correspond respectively to the extremes of the dimensional, in particular longitudinal, variations of the first 2 and third 4 reservoirs with respect to the second reservoir 3.

As can be seen in FIG. 1, the container 1 can have a fixed and rigid link 15 between, for the one part, one longitudinal end of the second reservoir 3 and, for the other part, the adjacent longitudinal end of the first reservoir 2 and one end of the third reservoir 4 or of a support element secured to the latter. This means that the fixed and rigid link 15 prevents the longitudinal movement of one longitudinal end of the first 2 and of the third 4 reservoir with respect to the second reservoir 3 while allowing longitudinal travel of the opposite end of the first 2 and third 4 reservoir with respect to the second reservoir 3.

Thus, in this case, the articulated tie rods 5, 6 are preferably situated at the other end (opposite to the fixed link 15), which has at least this degree of longitudinal freedom.

The holding system can have a first set of tie rods 5, having a first end 7 connected to the second reservoir 3 and a second end 8 connected rigidly to the first reservoir 2. This first set of tie rods 5 comprises a plurality of tie rods 5, in particular four tie rods 5, the first end 7 of which is situated at a first longitudinal end of the second reservoir 3 (for example the left-hand end in FIG. 1), the second end 8 of the tie rods 5 being connected to a first longitudinal end of the first reservoir 2 (left-hand end in FIG. 1).

Figure 4:
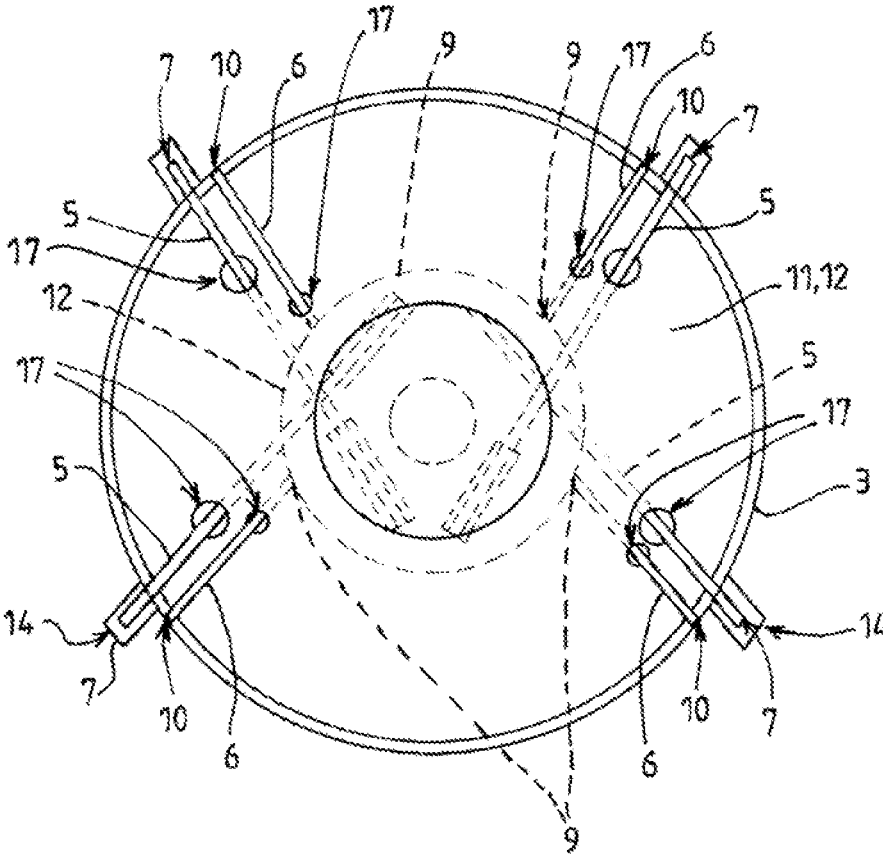
FIG. 4 shows a different schematic and partial cross-sectional view of one longitudinal end of the container.

As illustrated in FIG. 4, for example, the first set of tie rods 5 may comprise two upper tie rods 5 that have their first end 7 connected to the upper part of the second reservoir 3 and their second end 8 connected to the lower part of the first reservoir 2. In addition, the other, lower tie rods 5 may have their first end 7 connected to the lower part of the second reservoir 3 and their second end 8 connected to the upper part of the first reservoir 2.

The upper and lower parts may be defined according to whether they are located above or below the central longitudinal axis A of the reservoir 2 or of the container 1.

Figure 2:
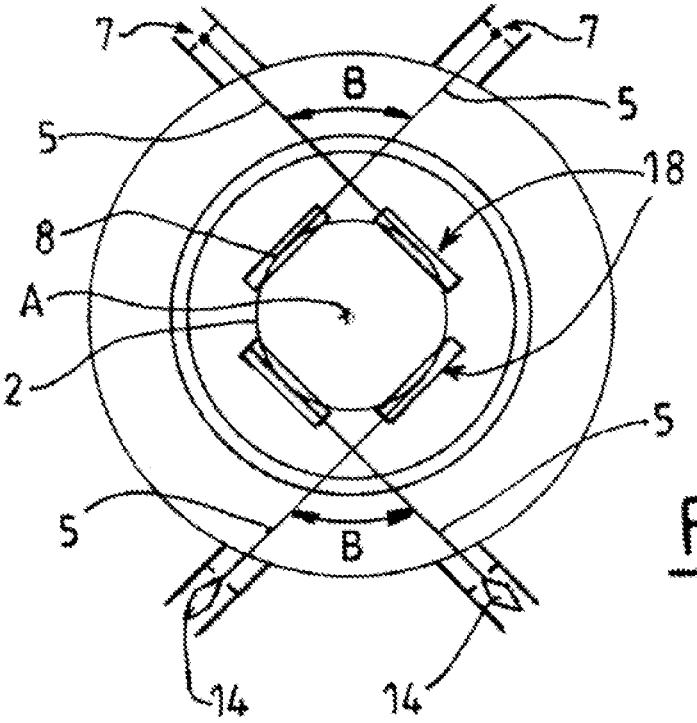
FIG. 2 shows a different schematic and partial cross-sectional view of one longitudinal end of the container.

In the variant in FIG. 2, the lower tie rods 5 have their second end 8 connected to the lower or central part of the first reservoir 2 and the upper tie rods 5 have their second end 8 connected to the upper or central part of the first reservoir 2.

The second reservoir 3 preferably has a cylindrical overall shape extending in the longitudinal direction A with a given radius of for example between 90 and 121.9 cm. The tie rods 5 of the first set of tie rods and of the second set of tie rods, respectively, have a length of preferably between 80 and 150% and preferably between 90 and 130% of the length of said radius.

As can be seen in FIG. 1, in side view, the upper tie rods 5 preferably intersect with the lower tie rods 5 (in a plane parallel to the longitudinal direction).

As schematically depicted in FIG. 1 or 2, the second ends 8 of the tie rods 5 may be housed in metal sheaths or tubes 18 in order to ensure the link to the first reservoir 2, extending the thermal path. This means that each tube 18 is fixed (welded for example) to the first reservoir 2, but the fixing of the second end 8 of the tie rod 5 to its tube 18 is offset with respect to the fixing between the tube and the reservoir 2 in order to extend the thermal path.

For example, the second end 8 of each tie rod 5 is bolted (or fixed in any other appropriate way) to a sheath or tube, which is itself welded (or the like) to the first reservoir 2. In addition, as can be seen in FIG. 1, these second ends 8 of the tie rods 5 can be fixed to an annulus or ring secured to the end of the first reservoir 1.

As illustrated in FIG. 2 (which, for the sake of simplification, only shows the first set of tie rods 5), in a plane perpendicular to the longitudinal direction A, the upper tie rods 5 may intersect at an angle B of between 70 and 130 degrees and preferably between 90 and 120 degrees. Similarly, the lower tie rods 5 may intersect at an angle of between 70 and 130 degrees and preferably between 90 and 120 degrees. Cf, also FIG. 4.

Preferably, this first set of tie rods 5 is not articulated or is weakly articulated so as to ensure a fixed hold (or a low tolerance of movement) of the first end of the first reservoir 2 with respect to the second reservoir 3 (in particular in the case of the fixed link 15).

The container 1 comprises a second set of tie rods 5 of the same kind as the first set at the other longitudinal end of the container 1 (on the right in FIG. 1). These tie rods 5 of the second set have a first end 7 connected to the second reservoir 3 and a second end 8 connected rigidly to the first reservoir 2. This second set of tie rods comprises a plurality of tie rods 5, in particular four tie rods 5, the first end 7 of which is situated at the second longitudinal end of the second reservoir 3. The second end 8 of the tie rods 5 is connected to the second longitudinal end of the first reservoir 2 (as above, preferably via an annulus or tube secured to the end of the first reservoir 2).

The tie rods of the second set of tie rods 5 may be arranged like those of the first set (cf. FIG. 2 or 4 and the description above).

At each longitudinal end of the container 1, the second ends 8 of the tie rods 5 can be connected to the first reservoir 2 or to a neck fixed to the latter.

In addition, preferably, the ends 7 of the tie rods 5 of the second set are articulated so as to allow in particular travel of the second end of the first reservoir 2 in the longitudinal direction (cf. FIG. 1, the retracted position indicated by dashed lines).

Figure 3:
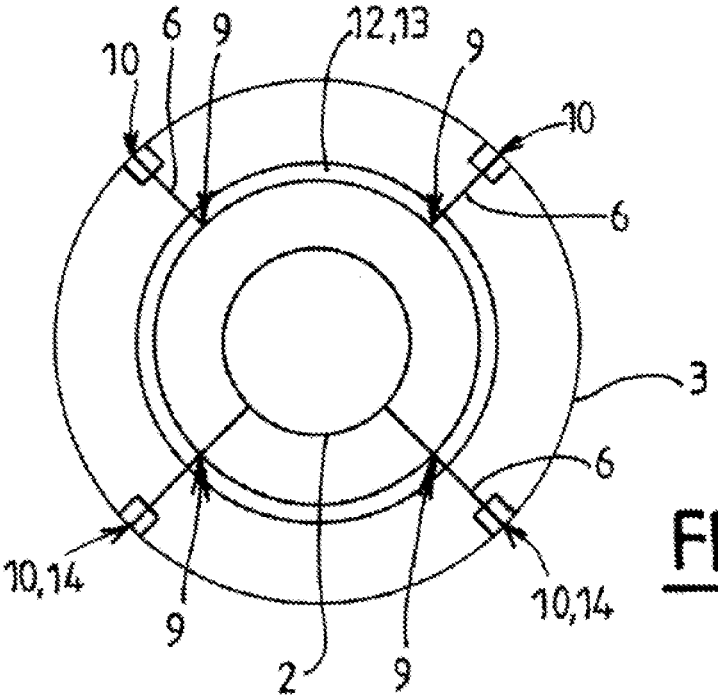
FIG. 3 shows a different schematic and partial cross-sectional view of one longitudinal end of the container.

As can be seen in FIGS. 1, 3 and 4, the container 1 comprises a third set of tie rods 6, in particular four tie rods 6, having a first end 10 connected to the second reservoir 3 and a second end 9 connected to the third reservoir 4 via a support 11, 12, 13 rigidly connected to the latter. As can be seen in FIGS. 3 and 4, the first end 10 of the tie rods 6 of the third set is situated at the first longitudinal end of the second reservoir 3. The second end 9 of said tie rods 6 is situated at the first longitudinal end of the container 1.

The third set of tie rods 6 comprises preferably two upper tie rods 6, the first end 10 of which is situated in the upper part of the second reservoir 3 and the second end 9 of which is situated in the upper part of the first reservoir 2 (cf. FIGS. 3 and 4). The two lower tie rods 6 preferably have the first end 10 connected to the lower part of the second reservoir 3 and the second end 9 situated in the lower part of the first reservoir 2.

Preferably, in a plane perpendicular to the longitudinal direction A (cf. FIG. 3 or 4), the two upper tie rods 6 are oriented relative to one another at an angle of between 60 and 110 degrees and preferably between 70 and 90 degrees, and the two lower tie rods 6 are oriented relative to one another at an angle of between 60 and 110 degrees and preferably between 60 and 90 degrees.

The container 1 comprises a fourth set of tie rods 6 at the other end of the container 1, which may be arranged in the same configuration as the third set (cf. above and FIGS. 3 and 4).

The tie rods 6 of the third set of tie rods, and of the fourth set of tie rods, respectively, have a length of between 30 and 80% and preferably between 40 and 60% of the length of the radius of the section of the second reservoir 2.

Thus, the two internal reservoirs 2, 4 are carried and suspended in the first, external reservoir 1 via tie rods 5, 6 situated at the two ends of the container 1.

As illustrated in FIG. 1, the second ends of the tie rods 6 supporting the third reservoir 4 can be connected to annuli 13 or plates secured to the third reservoir 4 via the shielding walls 11, 12.

This means that the second ends 9 of the tie rods 6 can be connected to respective annuli 13 that also form the support for the shielding walls 11, 12.

In addition, as can be seen in FIG. 4, all or some of the tie rods 5, 6 can pass through these shielding walls 11, 12 via respective orifices 17.

Further tie rods or holding/support members may potentially optionally be provided between these two ends of the container 1.

The articulated tie rods 5, 6 (at the free end of the first and third reservoirs) are configured to pivot about their end 7, 10 connected to the second reservoir 3 through an angle of for example between 10 and 20 degrees and corresponding to travel in the longitudinal direction of their second end 8, 9 of for example between 1 and 50 mm and in particular between 30 and 40 mm (for a container having a length of about 12 meters).

In the case of a the fixed and rigid link 15 at one longitudinal end, this prevents the longitudinal movement of one longitudinal end of the first 2 and of the third 4 reservoir with respect to the second reservoir 3 while allowing longitudinal travel of the opposite longitudinal end of the first 2 and third 4 reservoir with respect to the second reservoir 3. This travel is made possible via the articulated tie rods 5, 6.

In addition, preferably, at least some of the ends 10 and 7 of the tie rods 5, 6 connected to the lower part of the second reservoir 3 are mounted on respective elastic supports 14 that allow and a dampening a limited vertical travel with respect to the second reservoir 3. These elastic supports 14 may comprise for example a stack of Belleville washers, a damper, a spring or any other appropriate member.

Conventionally, the fixed and rigid link 15 may comprise tubular walls that extend back and forth in the longitudinal direction A so as to create an insulating thermal path between the second reservoir 3, for the one part, and the first 2 and third 4 reservoirs, for the other part (cf. for example DE102014206370A1). This thermal path may comprise a tube made of epoxy/glass composite or the like on the thermal path.

Figure 6:
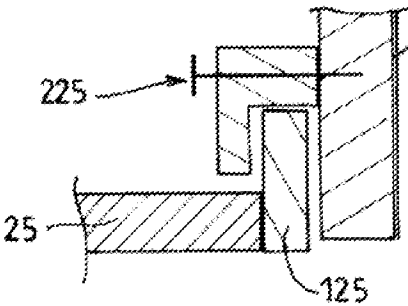
FIG. 6 shows a schematic and partial view in longitudinal section illustrating a possible exemplary embodiment of an enlarged detail of FIG. 5.

As schematically depicted in FIG. 6, the axial fixed link 15 (in the longitudinal direction A) between the second reservoir 3 and the first reservoir 2 may comprise a wall 25 (made of epoxy/glass composite or metal such as titanium for example), one end 125 of which is longitudinally blocked by a longitudinal stop 225 secured to the first reservoir 2. The longitudinal stop 225 is for example a fixing flange that prevents the relative rotation of the two components.

Figure 7:
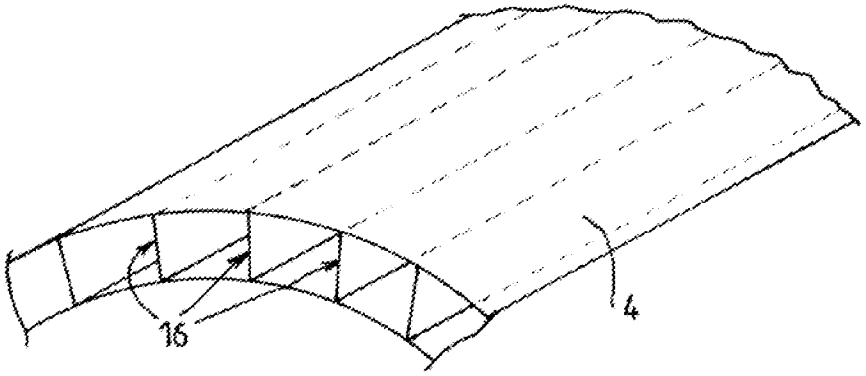
FIG. 7 shows a schematic and partial perspective views illustrating a possible exemplary embodiment of an enlarged detail in cross section of a reservoir from FIG. 1.
Figure 8:
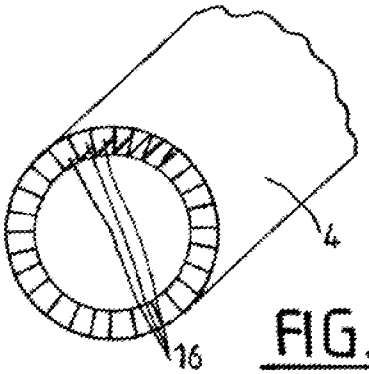
FIG. 8 shows a schematic and partial perspective views illustrating a possible exemplary embodiment of an enlarged detail in cross section of a reservoir from FIG. 1.
Figure 5:
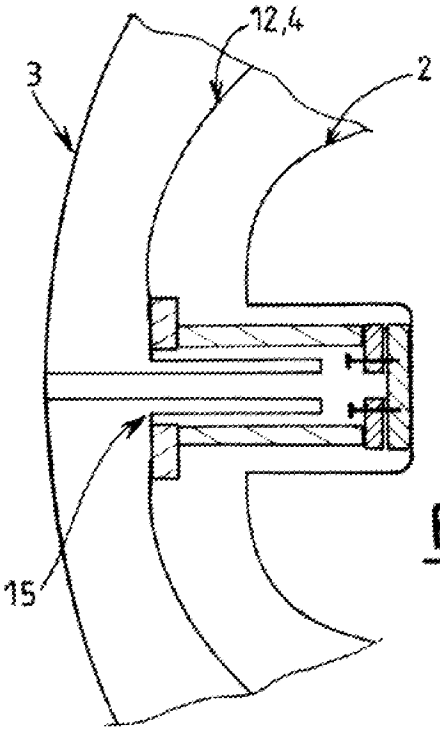
FIG. 5 shows a schematic and partial view in longitudinal section illustrating a possible exemplary embodiment of an enlarged detail of FIG. 1.

As illustrated in FIGS. 7 and 8, the two cylindrical walls delimiting the third reservoir 4 may comprise spacers or stiffeners that separate them from one another. This makes it possible to minimize the thickness of the walls or shells by balancing the effect of the pressure and by reinforcing the assembly in particular axially (in the longitudinal direction A). The deflection of the cylindrical part is a few millimeters when fully filled with liquid nitrogen and under 4 g of acceleration during handling. The evaporated nitrogen can be evacuated to the atmosphere through a pipe, which is not shown for the sake of simplification. The pressure therein can be maintained at typically 0.5 bar by an overflow valve. This third annular reservoir 4 may also be equipped with a filling pipe and a safety line connected to a valve.

As can be seen in FIGS. 7 and 8 and without this being limiting, the spacers 16 or stiffeners can extend in the longitudinal direction A. This configuration makes it possible in particular to manufacture the two walls and the spacers thereof by extrusion.

Thus, while having a simple and inexpensive structure, the container 1 makes it possible to increase the nitrogen volume, for example from 1200 to 3000 liters with an annular height of 40 mm (distance between the two concentric walls of the third reservoir 4). This configuration minimizes the reduction in volume of the first reservoir 2.

The hyperstatic support structure allows a uniform distribution of the mass of the third reservoir 4 so as to avoid overfilling on the rear axles in the case of road transport or an imbalance during handling.

This architecture makes it possible to ensure very good thermalization (no need for a cooling circuit). This design functions even with a very small amount of nitrogen at the end of the journey. Ingress of heat is transmitted by conduction through the shells 4 to the liquid nitrogen. There is no risk of malfunctioning of the cooling circuit with a low rate of evaporation and increase in temperature in the upper part of the third reservoir 4.

The two cylindrical walls of the third reservoir 4 (shells) act as two heat shields in series. The outer wall receives the heat flux coming from the second reservoir 3. The inner wall receives the heat flux from the external wall, which has a temperature that is close for example to 90K. This reduces the heat flux toward the first reservoir 2 (for example to 4K).

The hyperstatic support and holding structure allows a good distribution of masses, a hold allowing expansions and contractions, and integrity during transports.

The third reservoir 4 (and the shielding walls 11, 12) is a rigid assembly that can be self-supporting by way of the tie rods 6 from the wall of the second reservoir 3. This makes it possible to avoid compression of the inter-wall insulation. This therefore avoids thermal defects and improves the degassing of the insulation, avoiding local compaction of the insulating material.

The third reservoir 4 forming a shield may bear directly on the insulation disposed around the first reservoir 2. This insulation (not shown) may comprise layers of insulating materials that are conventionally used.

The container can be housed in (fixed to) a parallelepipedal frame enabling the transport thereof.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A container for storing and transporting liquefied gas, comprising:

a first, internal reservoir that extends in a longitudinal direction (A) and is configured to store the liquefied gas, a second, external reservoir that is disposed around the first reservoir with a vacuum insulated space between the first and the second reservoir, a third, annular reservoir that is disposed around the first reservoir, between the first and the second reservoir, the third reservoir extending around at least a part of the first reservoir and containing a liquefied gas in order to form a heat shield for thermally insulating the first reservoir, a device for holding the first and third reservoirs in the second reservoir, the holding device being configured to allow limited travel of the first and third reservoirs in the second reservoir when undergoing dimensional variations caused by temperature variations, the holding device comprising a set of tie rods, wherein at least some of the tie rods have a first end connected in an articulated manner to the second reservoir and a second end connected rigidly to the first reservoir or to the third reservoir or to a structural component rigidly connected to said first or third reservoir, the articulated tie rods being movable between two given angular positions that respectively define two distinct positions of the second end of the tie rods and correspond respectively to the extremes of the dimensional variations of the first and third reservoirs with respect to the second reservoir.

2. The container as claimed in claim 1, further comprising a first set of tie rods having a first end connected to the second reservoir and a second end connected rigidly to the first reservoir, the first set of tie rods comprising a plurality of tie rods, the first end of which is situated at a first longitudinal end of the second reservoir, the second end of the tie rods being connected to a first longitudinal end of the first reservoir.

3. The container as claimed in claim 2, wherein the first set of tie rods comprises two upper tie rods that have the first end connected to the upper part of the second reservoir and the second end connected to the lower part of the first reservoir, and two lower tie rods that have the first end connected to the lower part of the second reservoir and the second end connected to the upper part of the first reservoir.

4. The container as claimed in claim 2, further comprising a second set of tie rods having a first end connected to the second reservoir and a second end connected rigidly to the first reservoir, the second set of tie rods comprising a plurality of tie rods, the first end of which is situated at a second longitudinal end of the second reservoir, the second end of the tie rods being connected to the second longitudinal end of the first reservoir.

5. The container as claimed in claim 4, wherein the second set of tie rods comprises two upper tie rods, the first ends of which are connected to the upper part of the second reservoir and the second ends of which are connected to the lower part of the first reservoir, and two lower tie rods that have the first ends connected to the lower part of the second reservoir and the second ends connected to the upper part of the first reservoir.

6. The container as claimed in claim 3, wherein, in a plane perpendicular to the longitudinal direction (A), the upper tie rods intersect at an angle of between 70 and 130 degrees and in that the lower tie rods intersect at an angle of between 70 and 130 degrees.

7. The container as claimed in claim 3, wherein, in a plane parallel to the longitudinal direction (A), the upper tie rods intersect with the lower tie rods.

8. The container as claimed in claim 2, wherein the second reservoir has a cylindrical overall shape extending in the longitudinal direction (A) with a given radius, and in that the tie rods of the first set of tie rods and of the second set of tie rods, respectively, have a length of between 80 and 150% of the length of said radius.

9. The container as claimed in claim 1, further comprising a third set of tie rods that have a first end connected to the second reservoir and a second end connected to the third reservoir or to a support rigidly connected to the latter, the first end of the tie rods of the third set being situated at the first longitudinal end of the second reservoir, the second end of said tie rods being situated at the first longitudinal end of the second reservoir.

10. The container as claimed in claim 9, wherein the third set of tie rods comprises two upper tie rods, the first end of which is situated in the upper part of the second reservoir and the second end of which is situated in the upper part of the first reservoir, and two lower tie rods, the first end of which is connected to the lower part of the second reservoir and the second end of which is situated in the lower part of the first reservoir.

11. The container as claimed in claim 1, further comprising a fourth set of tie rods that have a first end connected to the second reservoir and a second end connected to the fourth reservoir or to a support rigidly connected to the latter, the first end of the tie rods of the third set being situated at the second longitudinal end of the second reservoir, the second end of said tie rods being situated at the second longitudinal end of the second reservoir.

12. The container as claimed in claim 10, wherein, in a plane perpendicular to the longitudinal direction (A), the two upper tie rods are oriented relative to one another at an angle of between 60 and 110 degrees, and the two lower tie rods are oriented relative to one another at an angle of between 60 and 110 degrees.

13. The container as claimed in claim 10, wherein the tie rods of the third set of tie rods, and of the fourth set of tie rods, respectively, have a length of between 30 and 80% of the length of the radius of the section of the second reservoir.

14. The container as claimed in claim 1, wherein the articulated tie rods are configured to pivot about the end connected to the second reservoir through an angle of between 10 and 20 degrees, corresponding to travel of their second end in the longitudinal direction of between 1 and 50 mm.

15. The container as claimed in claim 1, further comprising a fixed and rigid link between, for the one part, a longitudinal end of the second reservoir and, for the other part, the adjacent longitudinal end of the first reservoir and one end of the third reservoir or of a support element secured to the latter.

16. The container as claimed in claim 15, wherein the fixed and rigid link comprises walls that extend back and forth in the longitudinal direction (A) so as to create an insulating thermal path between the second reservoir, for the one part, and the first and third reservoirs, for the other part.

17. The container as claimed in claim 1, wherein at least some of the ends of the tie rods connected to the lower part of the second reservoir are mounted on an elastic support that allows dampening and provides a limited vertical travel with respect to the second reservoir.

* * * * *